United States Patent [19]

Carmichael

[11] Patent Number: 4,648,601

[45] Date of Patent: Mar. 10, 1987

[54] MULTI-LEVEL BOARD GAME

[76] Inventor: Tracy J. Carmichael, 17300 Freeland St., Detroit, Mich. 48235

[21] Appl. No.: 729,417

[22] Filed: May 1, 1985

[51] Int. Cl.[4] ..... A63F 3/00

[52] U.S. Cl. ..... 273/241; 273/256

[58] Field of Search ..... 273/256, 241, 278; D21/33-36

[56] References Cited

U.S. PATENT DOCUMENTS

| | | | |
|---|---|---|---|
| 2,026,082 | 12/1935 | Darrow | 273/256 |
| 2,178,330 | 10/1939 | Thomas | 273/256 X |
| 4,062,544 | 11/1975 | Hankins | 273/256 |
| 4,312,510 | 1/1982 | Bodner | 273/256 |
| 4,477,080 | 10/1984 | Baker | 273/241 |
| 4,522,407 | 6/1985 | Hatherley | 273/256 |
| 4,585,266 | 4/1986 | Wilson | 273/256 |

FOREIGN PATENT DOCUMENTS

| | | | |
|---|---|---|---|
| 2230460 | 3/1979 | Fed. Rep. of Germany | 273/241 |
| 2132907 | 7/1984 | United Kingdom | 273/256 |

*Primary Examiner*—Paul E. Shapiro

[57] ABSTRACT

A multiple level board game utilizes the fields of real estate, banking, and general business to maximize a player's financial wealth at the expense of opponent players. A multiple level board having a continuous playing field is divided into playing spaces representing utilities, transportational businesses, and real estate which are subject to acquisition. Playing spaces are disposed generally around the perimeter of the lower level of the board game, continuing to the upper level and back down to the lower level affording continuous playing field. The game accessories include tokens for each player, title deed cards, bogus money, instructional cards, loan chart, account boards, and buildings which are subject to acquisition and are used against an opponent player to force him into bankruptcy. Also provided is a chance device for determining the advance of tokens around the multiple level playing field of the board game.

4 Claims, 11 Drawing Figures

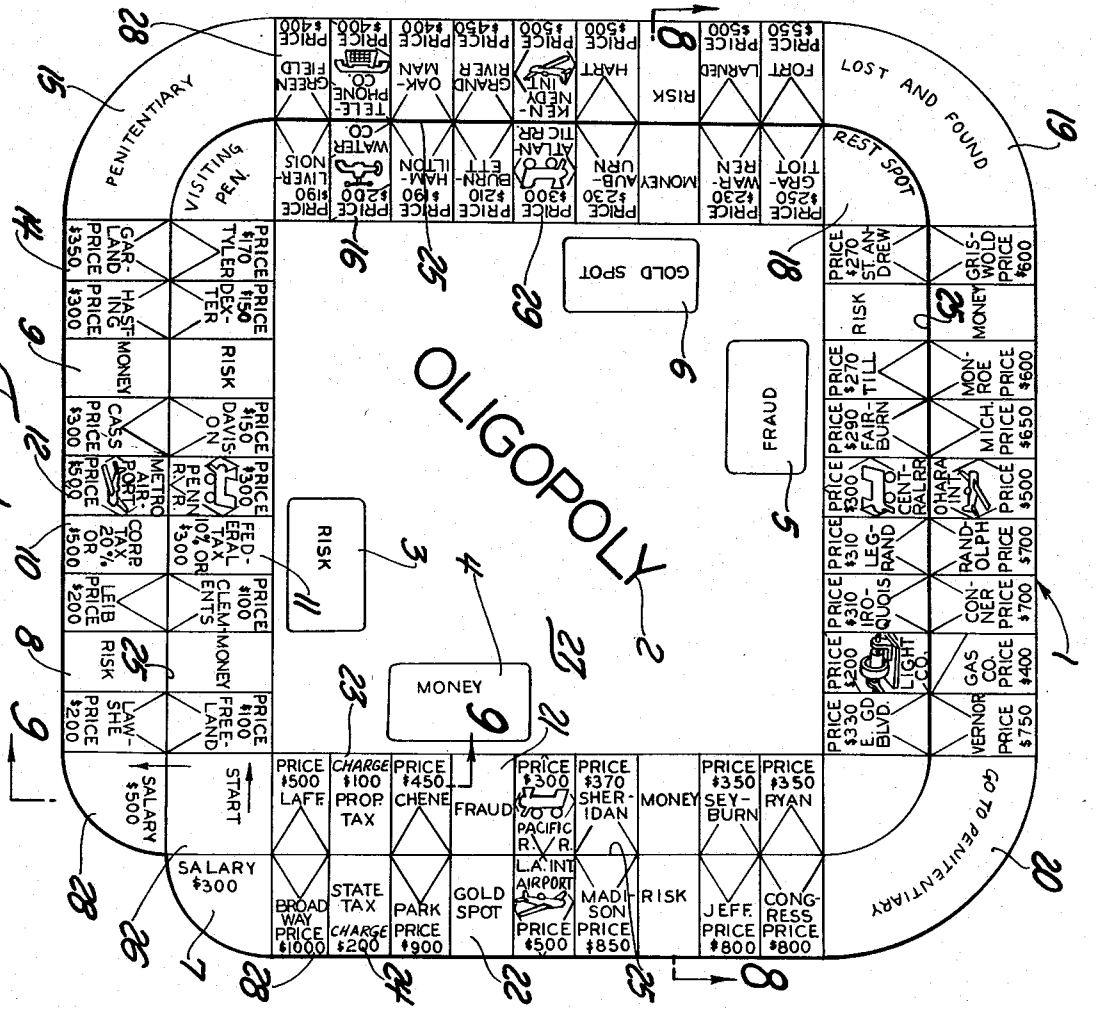
Fig. 1
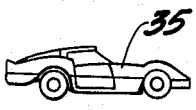
Fig. 2
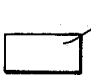
Fig. 4
| SAVING ACCOUNT BOARD | |
|---|---|
| 100 | 1000 |
| 200 | |
| 300 | 2000 |
| 400 | |
| 500 | 3000 |
| 600 | |
| 700 | 4000 |
| 800 | |
| 900 | 5000 |
Fig. 7
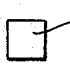
Fig. 3
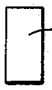
Fig. 5
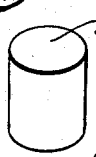
Fig. 6

MULTI-LEVEL BOARD GAME

BACKGROUND OF THE INVENTION

The invention relates generally to amusement devices such as games and more particularly to board games simulating various fields of business such as banking, real estate and property management.

Board games which attempt to simulate various aspects of the field of business and real estate are well known, but almost all use various means to move tokens around a continuous outer or inner track or both.

SUMMARY OF THE INVENTION

The present invention contemplates a board game for simulating real estate, banking and business situations which includes a game board having a first portion at a first level and a second portion surrounding the first portion at a second level with one of the levels being higher than the other. A plurality of contiguous marked spaces define a path extending around the first portion and form a closed track adjacent to the second portion of the game board. Similarily, a second plurality of contiguous marked spaces are formed on the second portion to define another continuous closed track adjacent to and surrounding the path on the first portion of the game board. A single space is provided which is common to the first and second tracks with the single space including a first portion defining a ramp extending from the path on the first level to a first space on the second level together with a second portion defining a ramp extending between a second space on the second level to the path on the first level together with means preventing pieces placed on the higher level from falling onto the lower level. The game apparatus also includes tokens for movement by each player, means for determining the number of spaces the tokens are to be moved, means for defining subgroups of spaces different from the other sub groups, means for indicating rental fees required for use and occupancy of spaces, simulated money for use by the players of the game, means for keeping records during the game for each of the players and a banker and means simulating buildings for placement on selected spaces to indicate increased rental values.

DESCRIPTION OF THE DRAWINGS

FIG. 1 is a plan view of a game board and playing surface made in accordance with a preferred embodiment of this invention;

FIG. 2 is a token in the form of a car used as a playing piece by players of the board game;

FIGS. 3, 4, 5 and 6 are views of playing pieces used as buildings;

FIG. 7 is a plane view of a savings account board used during play of the game to record a player's bank account during the game;

DESCRIPTION OF THE PREFERRED EMBODIMENT

Figure 8:
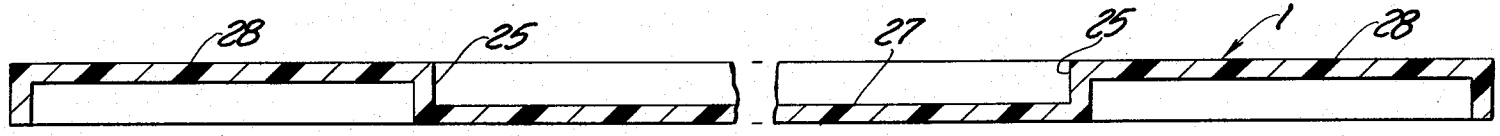
FIG. 8 is an enlarged cross-sectional view of a game board taken along line 8—8 of FIG. 1.
Figure 11:
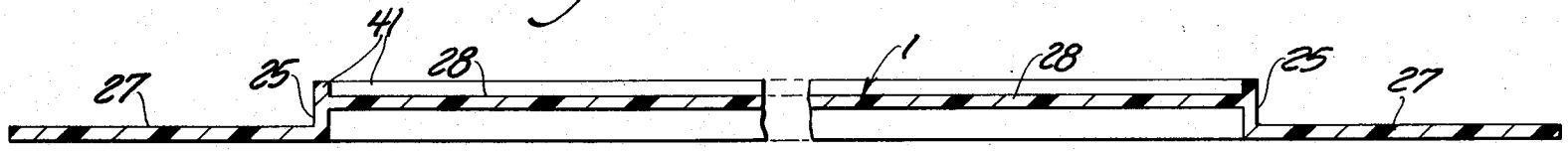
FIG. 11 is a cross-sectional view also taken along line 8—8 of FIG. 1 showing a construction of another embodiment of the invention.

FIGS. 1, 8, and 11 are views of a multiple level board game however FIG. 1 can also be viewed as one level in another embodiment of said invention. FIGS. 1, 8, and 11 are views of the multiple level board game of the present invention and all of it preferred embodiments. The present invention is a multiple board game apparatus wherein the fields of real estate, banking, and general business are utilized through bartering, trading, and striking shrewd business deals to force other opponents into bankruptcy, comprising token means for indentifying each player prior to and throughout game. Also, bogus money means are utilized to acquire real estate properties and pay rental fees during game play and for certain other aspects of the game. A board having a continuous playing field extending around the perimeter of the board from the lower to upper level and back down again, said play field being made up of a plurality of contiguous playing spaces, said space affording a continuous track or path for the purpose of continuity of play and a chance means for advancing the players' tokens around said play field on said board game. The game contemplates that each player will by chance attempt to take advantage of as many business situations as they can in accordance with the rules of the game and utilize the business situation to their advantage against their opponent players. The goal is to force their opponent(s) in to bankruptcy and to become richest player. The preferred embodiment described herein has a maximum of twelve players. The game may also be play with teams. Twelve players can be broken up into up to six man teams. Each player is given $5000 of bogus money divided as follows: 1—$1000's, 4—$500's, 5—$100's, 6—$50's, 6—$20's, 5—$10's, 5—$5, 5—$1; and $1000 on account along with a personal account board to keep track of each players' account and tokens. The remainer of the money and all other equipment goes to the bank. All players will then place their tokens on the space marked start. This space is divide into two levels, residential and business level; all players must start on the same level either the business or residential. Each player moves his token around the continuous multiple level board by chance means. Preferrably, by a pair of dice. Each player than advances around the board game, buying, selling, loaning, renting, borrowing from the bank, collecting salary, making deals with other opponents, and using everything in the rules to force opponents into bankruptcy. The last player left is the winner.

DESCRIPTION OF THE DRAWINGS

The FIG. 1 of drawings shows the game board of the present invention in its preferred embodiment. Referring to FIG. 1 of the drawing, the board game apparatus is comprised of a multiple level, as to allow continuity of play on two level. The levels acting as a playing field having marked spaces constituting a path or track extending about the board game, the back or path affording a continuous track for the purpose of continuity of play. The board game in FIG. 1 is essentially square having two levels. The entire mutiple level board game with a continuous playing field on both levels is indicated by No. 1. FIGS. 8 and 11 shows two embodiments of the present invention. However, FIGS. 1 and 8 will be utilized as the preferred embodiment. The board game name "OLIGOPOLY" is indicated on interior of board game as No. 2. However, my invention is not limited to the name oligopoly at this time. Also, on the interior of the board game numbers 3,4,5, and 6 are indicated places or boxes where four sets of instructional chance cards are respectively piled, preferrably face down. The corresponding names are No. 3 "RISK", No. 4 "MONEY", No. 5, "FRAUD", and No. 6 "GOLD SPOT". A player that is compelled by the rules of the game to draw from one of the four decks on the interior of the board game takes the top card from the pack indicated and after following instructions printed thereon, returns the card face up to the bottom deck or set of such cards, after the entire deck is face up, then deck is reshuffled and play is continued. The board game provide play spaces along four sides and on upper and lower levels of the board game that are not subject to acquisition by individual players, but which provide certain change advantages and disadvantages should the player chance to land on one these spaces. Referring to board game illustrated in FIG. 1 No. 7 is one of such spaces. No. 7 is a special bi-level space which covers the upper and lower or business and residential level, preferrably called start; it's also marked $300 and $500 respectively. This space is the marker which the banker pays the players salaries when a player's tokens lands or passes over the salary printed thereon. This space also contain special ramps so the player's tokens can move back and forth between the upper and lower levels continuously (note: see FIG. 10 for a detailed view). Similarly, the following numbered the play spaces are not for acquistion and offers advantages and disadvantages when a player chance to land thereon: Numbers 8, 9, 10, 11, 15, 18, 19, 20, 21, 22, 23 and 24. No. 8 is a space that corresponds and is utilized with box No. 3 on the interior of the board game. When a player's token lands on this space and others like it, he then picks an instruction card from the No. 3 deck. No. 8 covers five other spaces which are distributed around the upper and lower levels of the board game. This space is preferrably called "RISK". No. 9 is a space which corresponds and is utilized with box No. 4 on the interior of the board. When a player's token lands on this space and others just like it, he then picks a instructional card from that deck which is No. 4. No. 9 covers 5 other spaces which are distributed around the board's upper and lower level, this space is preferrably called money. No. 10 space is preferrably called corperate tax $500 or 20% if a player's token lands on it he would then pay $500 or 20% of his total wealth to the bank. No. 11 this space is preferrably called federal tax $250 or 10%, if a player's token lands on it he would then pay $250 or 10% of his total wealth to the bank. No. 15 this is a single corner space which covers the upper and lower levels. Preferrably called penitentiary and visting pen. This space houses the player's tokens that are sent to penitentiary by chance means. This space is also visting pen. Space for the token that just happen to land on this space during the course of the game, and not sent to No. 15 for any reason. No. 18 is one half of a bi-level corner space. This bi-level space has two function. The lower or residential level of the game board is called rest spot which can be switched or alternated with No. 19. No. 18 is a free spot which has no function at all. It's just a rest spot. No. 19 is the other half of the bi-level corner space mentioned in No. 18. No. 19 is preferrably called lost and found which is a corner space on the upper or business level of the game board which can be switched or alternated with No. 18 No. 19. If a player lands on this space by chance, he can receive only money. If there's some money on it. For example: every time a player has to pay a fine or penality, (not rent or purchases) the banker will place the money in the lost & found tray and if and when a player lands on this space he will receive what is in the tray, if there's nothing there he just treats that space as a free space. No. 20 is a corner space preferrably called go to penitentiary. This space covers both upper and lower levels. When player lands on this space, he must then immediately move his token to the penitentiary space on the same level. If the player is on the upper level of go to penitentiary, he must move his token to penitentiary on the upper level of the board game. If he is on the lower level of go to peniteniary, he must move his token to the peniteniary on the lower level of the board game. No. 21 is a space corresponding and utilized with box No. 5 on the interior of the board. When a player's token lands on this space, he would then pick a instructional card from that deck which is No. 5. This space is on the residential or lower level; it is preferrably called fraud. No. 22 is a space corresponds and is utilized with box No. 6 on the interior of board game. When a player's token lands on this space, he would then pick a instructional card from that deck which is No. 6. This space is on the business or upper level; it is preferrably called gold spot. No. 23. This space is called property tax; if a player's token lands on this space, he then pays $100 or what ever price printed on that space to the bank. No. 23 is located on the lower or residential level on the board game. No. 24. This space is called property tax; if a player's token lands on this space, he then pays $200 or what ever price printed on that space to the bank. No. 24 is located on the upper or business level on the game board. This category represents the following spaces that can be bought, sold, rented, and mortgaged back to the bank: numbers 12, 14, 16, and 29. No. 12 covers a group of 4 different spaces which are preferrably called Metro Airport, Kennedy Intern'l Airport, Ohara Intern'l Airport, L. A. Intern'l Airport. These spaces are placed in the middle of the board's upper or business level. It is possible for these spaces to be switched or alternated with No. 29. No. 14 covers a group of 44 different spaces which is preferred as reality spaces. These spaces are marked with a street, avenue, place name and color triangle; the spaces are colored in sixteen different color groups around the board game's upper and lower level. The board game utilizes eight different colors. Notice that both levels color groups are exactly the same which may give a solid color diamond effect around the board game. Each real estate space is identifed in triangles not diamonds. The reality space can be improved by buying buildings from the bank to put on them for higher rent. No. 16 covers a group of four different spaces which is referred to as utilties spaces preferrably called Telephone Co., Water Co., Light Co. and Gas Co. These spaces are located on both the upper and lower level of the board game. No. 29 covers a group of 4 Different spaces which are preferrably called Penn. Railroad, Atlantic Railroad, Central Railroad, Pacific Railroad. This spaces are place in the middle of the board's lower or residential level. It is possible for these spaces to be switched or alternated with No. 12.

No. 25 recess part of board game.

No. 26 ramps for access to both levels.

No. 27 lower level of board game.

No. 28 upper level of board game.

FIG. 2 is a drawing of a perspective view of some of the buildings and its preferred embodiments that are used by players who acquire real estate location as designated by many of the spaces or areas;

FIG. 2, No. 35 a perspective view of tokens to be used in the board the game. Tokens will be distinguihed by color or vintage or both.

FIG. 3, No. 36 are office buildings approximately 50.

FIG. 4, No. 37 are apartment buildings approximately 50.

FIG. 5, No. 38 are highrise office buildings approximately 15.

FIG. 6, No. 39 are condominium approximately 15.

Note: each building will have a special build-in connecting device to hold the buildings in place and or together for a more orderly and stable playing field.

FIG. 7, No. 40 a perspective view of saving account board to used in the game.

FIG. 8 cross sectional view of the board game taken along arrows 8—8 of FIG. 1

Figure 9:
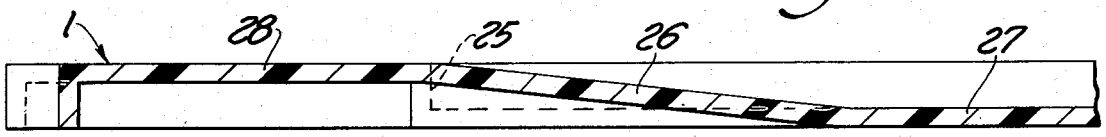
FIG. 9 is a cross-sectional view of a ramp taken along line 9—9 in FIG. 1.

FIG. 9 cross sectional view to upper and lower ramp for travel to upper and lower of the board game taken along arrows 9—9 of FIG. 1.

Figure 10:
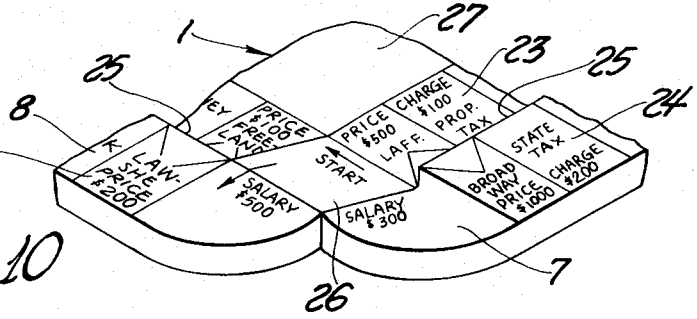
FIG. 10 is a perspective view of a portion of the board seen in FIG. 1 and illustrating a ramp forming part of the game board.

FIG. 10 a detail view of special start space with ramps for travel on all levels of the board game.

FIG. 11 cross sectional view taken along arrows 8—8 of FIG. 1 showing alternate construction of another embodiment of the invention. Also featured, is a railing No. 41 which prevents playing pieces from falling the upper level. This feature is not limited to one embodiment.

Additional play spaces are provided along the play field of the multiple board game which are not subject to acquisition by the individual players, but which provide certain chance advantages and disadvantages should the player chance to land on one of these play spaces. Referring to the board game illustrated in the FIG. 1, these play spaces are designate money, risk, fraud, and gold card and thier corresponding boxes are imprinted on the interior of the game board, as shown, outside of the playing field. A plurality of money, risk, fraud, and gold drawing cards, not shown, with either advantages or disavatages instructions imprinted thereon are provided for placement within the money, risk, fraud, gold card boxes on the interior of board game. If a player chances to land on either of the play spaces designated money, risk, fraud, or gold card, that player is directed to the respective box at the interior of the board game where upon he draws the top card in that box and follows the instructions imprinted thereon. Preferrably, money cards are provided having the following instructions:

| MONEY CARDS | |
|---|---|
| CASH REBATED ON CAR $200 | TALENT CONTEST $50 |
| TAX REFUND $200 | SOCIAL SECURITY $100 |
| INSURANCE REFUND $150 | INHERIT $300 |
| ADVANCES TO START | COMMODITIES & STOCK $300 |
| PAY CREDIT CARD $200 | GO TO PENITENTIARY |
| EMPLOYEE EMBEZZLES $300 | PAYROLL $500 |
| PAYROLL $300 | FIRE DAMAGE $200 |
| TAX BREAK $300 | ELECTION CONTRIBUTION $300 |
| RENOVATIONS FOR APT. $25 OFF. $100 | CONDO. $50 HIGHRISE $150 |

and preferrably, the risk drawings cards direct the player to pay or collect according to the following instructions:

| RISK CARDS | |
|---|---|
| ADVANCES TO START | COLLECT PERSONAL LOAN $50 |
| GET OUT OF PENITENTIARY | BANK PAYS INTEREST $100 |
| PAY TO CHARITY $150 | PAY TO CHARITY $300 |
| PARDON CARD | GO TO PENITENTIARY |
| ADVANCE TO WARREN | ADVANCE TO BROADWAY |
| ADVANCE TO THE NEXT R.R. | ADVANCE TO THE NEXT AIRLINE |
| ADVANCE TO THE LE GRAND | ADVANCE TO LAFAYETTE |
| ADVANCE TO MICHIGAN | ADVANCE TO HAMILTON |
| GO BACK 3 SPACES | GO FORWARD 4 SPACES |
| ADVANCE TO A UTILITY | GO BACK TO A UTILITY |

and preferrably, the fraud drawings cards direct the player to pay or collect according to the following instruction:

| FRAUD CARDS | |
|---|---|
| BANK TAKES $300 ON ACC. | BANK CALL IN ON THE LOAN |
| CONDEMN APARTMENT BLG. | CONDEMN OFFICE BLG |
| BANK TAKES $500 ON ACC. | SWINDLE A PLAYER OUT OF $300 |
| GO TO PENITENTIARY | COMPUTER FRAUD PAY $400 |
| ESCAPE FROM PENITENTIARY | HIDE OUT ON THE REST SPOT |
| ADVANCE ON NEXT SALARY | RECEIVE $500 ON FIRE INS. |
| ADVANCE TO START | GO TO THE NEXT CORNER SPOT |
| RENOVATIONS FOR APT. $50 OFF. $150 | CONDO. $100 HIGHRISE $200 |

and preferrably, the gold drawings cards direct the player to pay or collect according to the following instructions:

| GOLD SPOT CARDS | |
|---|---|
| $200 ACCOUNT MONEY | SPECIAL LOAN IF OWN MONOPOLY |
| EXTRA BONUS PASSING START | PICK ON UTILITY |
| THE GOLD CARD | UNMORTGAGE A PROPERTY |
| PICK ON RAILROAD | PICK ON AIRLINE |

-continued

| GOLD SPOT CARDS | |
|---|---|
| $400 ACCOUNT MONEY | TIME EXTENSION ON LOAN |
| RECEIVE 1 FREE APARTMENT | RECEIVE 1 FREE OFFICE |
| 10% OF LOST & FOUND | RECEIVE A OPPONENT'S SALARY |
| RENT FREE CARD | |

Prefferably called loan chart, aids the banker in calculating how much a player is to recieve on a credit loan, according to the wealth of the player.

| CREDIT LOAN CHART | |
|---|---|
| WORTH | PRINCIPLE |
| $1-1000 | $1000 |
| $1001-2000 | $2000 |
| $2001-3000 | $3000 |
| $3001-4000 | $4000 |
| $4001-UP | $5000 |

Play spaces representing reality properties are grouped generally by color coded triangles as mentioned above. The number of real estate along with the number of business owned by a single player will determine the amount of the rental fees that player can charge as against opponent players. Preferrably, the following realty, utilities, and business property groupings and rental fees formulas are provided with respect to each property and are printed on the respective business tile deed cards:

TITLE DEED CARDS

| STREET | RENT | APT. #1 | APT. #2 | APT. #3 | APT. #4 | CONDO |
|---|---|---|---|---|---|---|
| 1 FREELAND | $5 | $20 | $50 | $100 | $200 | $350 |
| 2 CLEMENTS | $10 | $25 | $100 | $200 | $400 | $650 |
| 3 DAVISON | $12 | $50 | $150 | $300 | $500 | $700 |
| 4 DEXTER | $12 | $50 | $150 | $300 | $500 | $700 |
| 5 TYLER | $14 | $60 | $175 | $350 | $650 | $750 |
| 6 LIVERNIOS | $16 | $70 | $200 | $400 | $700 | $800 |
| 7 HAMILTON | $16 | $70 | $200 | $400 | $700 | $800 |
| 8 BURNETTE | $18 | $80 | $225 | $450 | $750 | $850 |
| 9 AUBURN ST. | $20 | $90 | $250 | $500 | $800 | $900 |
| 10 WARREN | $20 | $90 | $250 | $500 | $800 | $900 |
| 11 GRATIOT | $22 | $100 | $275 | $550 | $850 | $950 |
| 12 ST. ANDREW PL | $24 | $110 | $300 | $600 | $900 | $1000 |
| 13 TILL ST. | $24 | $110 | $300 | $600 | $900 | $1000 |
| 14 FAIRBURN | $26 | $120 | $325 | $650 | $950 | $1050 |
| 15 LE GRAND ST. | $28 | $130 | $350 | $700 | $1000 | $1100 |
| 16 IROQUOIS | $28 | $130 | $350 | $700 | $1000 | $1100 |
| 17 E. GRAND BLV. | $30 | $140 | $375 | $750 | $1050 | $1150 |
| 18 RYAN RD. | $32 | $150 | $400 | $800 | $1100 | $1200 |
| 19 SEYBURN | $32 | $150 | $400 | $800 | $1100 | $1200 |
| 20 SHERIDIAN | $34 | $160 | $425 | $850 | $1150 | $1250 |
| 21 CHENE ST. | $40 | $400 | $600 | $1000 | $1400 | $2000 |
| 22 LAFAYETTE | $55 | $500 | $750 | $1200 | $1800 | $2500 |
| STREET | RENT | OFF. #1 | OFF. #2 | OFF. #3 | OFF. #4 | HIGHRISE |
| 23 LAWSHE ST. | $10 | $50 | $100 | $200 | $400 | $450 |
| 24 LEIB ST. | $25 | $75 | $200 | $350 | $800 | $900 |
| 25 CASS | $30 | $100 | $300 | $400 | $850 | $1000 |
| 26 HASTING | $30 | $100 | $300 | $400 | $850 | $1000 |
| 27 GARLAND | $35 | $125 | $350 | $500 | $900 | $1100 |
| 28 GREENFIELD | $40 | $200 | $400 | $600 | $1000 | $1200 |
| 29 OAKMAN | $40 | $200 | $400 | $600 | $1000 | $1200 |
| 30 GRAND RIVER | $45 | $225 | $450 | $700 | $1100 | $1300 |
| 31 HART ST. | $50 | $300 | $500 | $800 | $1200 | $1400 |
| 32 LARNED ST. | $50 | $300 | $500 | $800 | $1200 | $1400 |
| 33 FORT ST. | $55 | $325 | $550 | $900 | $1300 | $1500 |
| 34 GRISWOLD | $60 | $400 | $600 | $1000 | $1400 | $1600 |
| 35 MONROE | $60 | $400 | $600 | $1000 | $1400 | $1600 |
| 36 MICHIGAN | $65 | $425 | $650 | $1100 | $1500 | $1700 |
| 37 RANDOLPH ST. | $70 | $500 | $700 | $1200 | $1600 | $1900 |
| 38 CONNER | $70 | $500 | $700 | $1200 | $1600 | $1800 |
| 39 VERNOR | $75 | $525 | $750 | $1300 | $1700 | $1900 |
| 40 CONGRESS | $80 | $600 | $800 | $1400 | $1800 | $2000 |
| 41 JEFFERSON | $80 | $600 | $800 | $1400 | $1800 | $2000 |
| 42 MADISON | $85 | $625 | $850 | $1500 | $1900 | $2100 |
| 43 PARK AVE. | $100 | $800 | $1200 | $1800 | $2200 | $3000 |
| 44 BROADWAY | $110 | $1000 | $1500 | $2000 | $2500 | $4000 |

| STREET | SELLING PRICE | MORTGAGED PRICE | BUILDING COST |
|---|---|---|---|
| 1 FREELAND | $100 | $50 | $50 |
| 2 CLEMENTS | $100 | $50 | $50 |
| 3 DAVISON | $150 | $75 | $50 |
| 4 DEXTER | $150 | $75 | $50 |
| 5 TYLER | $170 | $85 | $50 |
| 6 LIVERNIOS | $190 | $95 | $100 |

-continued

| | | | |
|---|---|---|---|
| 7 HAMILTON | $190 | $95 | $100 |
| 8 BURNETTE | $210 | $105 | $100 |
| 9 AUBURN ST. | $230 | $115 | $100 |
| 10 WARREN | $230 | $115 | $100 |
| 11 GRATIOT | $250 | $225 | $100 |
| 12 ST. ANDREW PL. | $270 | $235 | $150 |
| 13 TILL ST. | $270 | $235 | $150 |
| 14 FAIRBORNE | $290 | $245 | $150 |
| 15 LE GRAND ST. | $310 | $155 | $150 |
| 16 IROQUOIS | $310 | $155 | $150 |
| 17 E. GRAND BVLD. | $330 | $165 | $150 |
| 18 RYAN RD. | $350 | $175 | $200 |
| 19 SEYBURN | $350 | $175 | $200 |
| 20 SHERIDIAN | $370 | $185 | $200 |
| 21 CHENE ST. | $450 | $225 | $200 |
| 22 LAFAYETTE | $500 | $250 | $200 |
| 23 LAWSHE | $200 | $100 | $100 |
| 24 LEIB ST. | $200 | $100 | $100 |
| 25 CASS | $300 | $150 | $100 |
| 26 HASTING | $300 | $150 | $100 |
| 27 GARLAND | $350 | $175 | $100 |
| 28 GREENFIELD | $400 | $200 | $200 |
| 29 OAKMAN | $400 | $200 | $200 |
| 30 GRAND RIVER | $450 | $225 | $200 |
| 31 HART ST. | $500 | $250 | $200 |
| 32 LARNED ST. | $500 | $250 | $200 |
| 33 FORT ST. | $550 | $275 | $200 |
| 34 GRISWOLD | $600 | $300 | $300 |
| 35 MONROE | $600 | $300 | $300 |
| 36 MICHIGAN | $650 | $325 | $300 |
| 37 RANDOLPH ST. | $700 | $350 | $300 |
| 38 CONNER | $700 | $350 | $300 |
| 39 VERNOR | $750 | $375 | $300 |
| 40 CONGRESS | $800 | $400 | $400 |
| 41 JEFFERSON | $800 | $400 | $400 |
| 42 MADISON | $850 | $425 | $400 |
| 43 PARK AVE. | $900 | $450 | $400 |
| 44 BROADWAY | $1000 | $500 | $400 |

AIRPORTS & RAILROADS

| AIRPORT TITLE | RAILROADS TITLE |
|---|---|
| KENNEDY INT'L AIRPORT | PACIFIC RAILROADS |
| L.A. INT'L AIRPORT | CENTRAL RAILROADS |
| OHARA INT'L AIRPORT | PENN RAILROADS |
| METRO AIRPORT | ALANTIC RAILROADS |
| AIRPORTS PRICE | RAILROADS PRICE |
| $500 | $300 |
| MORTGAGE PRICE | MORTGAGE PRICE |
| $250 | $150 |
| AIRPORTS RENT | RAILROADS RENT |
| ADD $100 FOR EA. AIRPORT OWNED | ADD $50 FOR EA. RAILROAD OWNED |

UTILITIES

| UTILITY TITLE | UTILITY PRICE | UTILITY MORTGAGE | UTILITY RENT |
|---|---|---|---|
| LIGHT CO. | $200 | $100 | $50 FOR EA. |
| WATER CO. | $200 | $100 | $50 FOR EA. |
| GAS CO. | $400 | $200 | $100 FOR EA. |
| TELEPHONE CO. | $400 | $200 | $100 FOR EA. |

The board game of the present invention is played in accordance with the following rules:

To begin the game, the player's tokens are placed on the corner space 7 which is designated start. Players can place their tokens either on the upper or lower level of this special bi-level space to begin play. A banker is chosen and he then distributes equal amount of bogus money preferrably $5000 divided as follows: 1—$1000's, 4—$500's, 5—$100's, 6—$50's, 5—$5's, 6—$20's, 5—$10's, 5—$1's, and $1000 in a savings account to each player. Starting with the banker and each player to his left rolls the dice to determine who goes first. The player with the highest roll will start off the game. That player then rolls again to determine how many play spaces on the play field he should advance his token. After he finishes his turn, he then turn the dice over to the player to his left and so on around the board. After each turn, the player's token remains on his last space until his next turn. There is no limit on how many tokens can stay on one space at the same time. When a player starts around the board, he can immediately acquire unowned property only if he lands on it, and property from other player if it's for sale. If it's owned, he then must pay the alotted rent. A player can begin receiving bonuses and be assessed with penalties. Each time a player completes a course around the board game and lands on or passes the corner space 7, designated start, that player receives from the bank either a $300 or $500 salary depending on which section of this bi-level space the player's token lands on or passes over, $300 for the lower or residential level and $500 for the upper or business level. When a player rolls doubles, he can roll again. If rolls three consecutive doubles he then must place has token on the space 15 which is preferrably called penitentiary. When a player wants to acquire reality property, he can (1) land on a unowned property in which he pays the bank for it. (2) buy it from another player, or (3) trade or make a legal deal with only the players [not the bank]. Players cannot loan property or give it away unless receiving something in a trade. When a player has fulfilled any one of the requirements listed above, he then receives a title deed card or cards for that space or spaces which contents all of the information for that property's rental charge, cost of property, cost of buildings, and mortgage loan. When a player wants to acquire buildings such as apartment, office, condomindiums, highrise buildings, the player must first have all the reality property in a color group on the same level in which he pays the preferred price to the bank, however, in the case of office and highrise buildings a player can obtain these buildings from another player as well as the bank (a player can charge what ever he can get for his buildings). Additional play spaces are provided along the perimeter of the multilevel board which are not subject to acquistion by the individual player, but which provide certain chance advantages or disadvantages, should the player chance to land on one of these play spaces. Referring to the board game illustrated in the FIG. 1. These play spaces are designated money, risk, fraud, and gold spot; which are instructional card spaces along with a corresponding boxes imprinted on the interior of the board game. Other spaces are not subject to acquistion are as follows: referring to board game illustrated in FIG. 1 are No. 10, 11, 15, 18, 19, 20, 23, 24, provide certain chance advantages or disavantages should the player chance to land on one of these play spaces. Loans: the bank has the authority issue 3 types of loans. mortgages loan, credit loan, and investment loan. (1) Mortgages loan: is when the bank loans a player one half the price paid for his property. The bank can issue a mortgage loan as many times as needed. Mortgage loans are paid back as follows: the player pays the principle plus 10% intrest, there no set time to paid back a mortgage loan and no limit on how many mortgage loans a player can have at any one time during the game. (2) Credit loan: the bank can issue a credit loan only once per person per game. A player can ask for a credit loan only to pay a debt. To qualify for this loan, a player must have at least one color group on any level and at least $300 in cash. If the player meets the requirements, he must then add up all his money and unmortgaged property (add property by their selling price) and buildings (add buildings by their selling price). After the total worth of the player is determine, the banker then will check his loan chart to determine how much the player will receive. If the loan plus his minimun $300 is not enough to pay the debt, the banker cannot grant the credit loan. (3) Investment loan: the bank can issue A investment loan only one time per person per game. A player can only use a investment loan for purchasing property or buildings and for personal savings for later in the game and not for paying debts. To qualify for the loan, a player must have at least one color group on any level and at least $500. If the player meets the requirements, he then will receive the loan for what ever amount he chooses, as long as it is not less than $500 and not more than $5000. A player can choose either a credit loan or a investment loan he cannot receive both in one game. However, he can receive a mortgage loan as many times as needed. Credit loans and investment loans must be paid back as follows: the player has one full trip around the board from the space where he received the loan, (which includes the upper and lower levels), to pay off the entire principle plus 10% in cash. If for any reason the player cannot pay off the loan, then he has one more full trip around the board from the space where he received the loan, (which includes the upper and lower level), to pay off the entire principle plus 100% in cash. If the player cannot pay the debt by this time, the bank then, immediately forecloses on his holdings, in which all properties, including mortgage properties and buildings are mortgaged back to the bank for half price. The bank keeps the properties and buildings as collateral until the player buys them back at full price plus 10% in cash at anytime. However, if another player lands on the property and want to buy those property and buildings, he can buy them from the bank. If the debt is more than the player worth, he is declared bankrupt and is immediately out of the game. If a player cannot pay a rental fee charged by an opponent player, all properties which he owns that are not mortgaged must be turned over to the player that is owed; all mortgaged property must go to the bank to be resold. The player is considered bankrupted and is out of the game. The invention in question is a multiple level board game that utilizes a field of business more specifically banking, general busness, and real estate: such as procuring, selling, loaning, mortgaging and renting properties/buildings. The invention utilizies business situations to create conquests and pitfalls as in the everyday business community, also is a board game wherein a player can identify with a small businessman striving for success. The game is exciting to play and embraces contemporary places, buinesses and social situations and can be participated in by most age groups. The board game multiple level also allows team play as many as six 2 person teams can play. Although the board game of the present invention has been described in considerable detail in the specifications it is not intended that the invention be limited to such detail except as neccessitated by the appended claims

I claim:

1. A board game apparatus for simulating real estate, banking and business situations comprising:

(a) a game board, said game board having a first portion at a first level and a second portion, surrounding said first portion, at a second level, one of said levels being higher than the other, a plurality of contiguous marked spaces defining a path extending around said first portion and defining a continuous closed track adjacent to said second portion of said game board; a second plurality of contiguous marked spaced on said second portion defining a continuous closed track adjacent to and surrounding said path on said first portion of said game board, a single space common to said first and second tracks, said single space comprising a first portion defining a ramp extending from said path on said first level to a first space on said second level and a second portion defining a ramp extending between a second space on said second level to said path on said first level, and means preventing pieces placed on said higher level from falling onto the other level;

(b) tokens for movement by each player along the paths;

(c) means for determing determining the number of spaces the tokens are to be moved;

(d) means defining subgroups of spaces different from the other subgroups defined thereby;

(e) means for indicating rental fees required for use and occupancy of said spaces;

(f) simulated money for use by the players of the game;

(g) means for keeping records during the game for each player and a banker and;

(h) means simulating buildings for placement on selected spaces for indicating increased rental values.

2. The game board apparatus of claim 1 wherein said record keeping means comprises savings account boards.

3. The game board apparatus of claim 1 wherein said means for preventing falling is a railing about said upper level and adjacent said other level.

4. The game apparatus of claim 1 further comprising means to facilitate calculating credit loans.

* * * * *